US010697122B2

(12) United States Patent
Lockhart et al.

(10) Patent No.: US 10,697,122 B2
(45) Date of Patent: Jun. 30, 2020

(54) PROCESS FOR MAKING PARTLY-HYDROLYZED CELLULOSE USING COMPRESSED CELLULOSIC MATERIALS

(71) Applicant: NORAM Engineering and Constructors Ltd., Vancouver (CA)

(72) Inventors: James M. Lockhart, Vancouver (CA); James T. Wearing, Vancouver (CA); Ali Gulamhusein, Vancouver (CA); Evan J. Hobenshield, Vancouver (CA); Durk Devries, Vancouver (CA)

(73) Assignee: NORAM Engineering and Constructors Ltd., Vancouver (CA)

( * ) Notice: Subject to any disclaimer, the term of this patent is extended or adjusted under 35 U.S.C. 154(b) by 880 days.

(21) Appl. No.: 14/429,953

(22) PCT Filed: Sep. 20, 2012

(86) PCT No.: PCT/CA2012/050658

§ 371 (c)(1),
(2) Date: Mar. 20, 2015

(87) PCT Pub. No.: WO2014/043781

PCT Pub. Date: Mar. 27, 2014

(65) Prior Publication Data

US 2015/0252531 A1 Sep. 10, 2015

(51) Int. Cl.
*D21H 17/65* (2006.01)
*D21C 9/00* (2006.01)
(Continued)

(52) U.S. Cl.
CPC ..... *D21H 17/65* (2013.01); *D21C 9/002* (2013.01); *D21C 9/004* (2013.01); *D21C 9/007* (2013.01);
(Continued)

(58) Field of Classification Search
USPC ..... 162/53
See application file for complete search history.

(56) References Cited

U.S. PATENT DOCUMENTS 2,450,586 A 10/1948 Dunning et al.
2,978,446 A 4/1961 Battista et al.
(Continued)

FOREIGN PATENT DOCUMENTS

GB 424970 A 2/1935
GB 874945 8/1961
(Continued)

OTHER PUBLICATIONS

Revol, J-F. et al, "Chiral-nematic suspensions of cellulose crystallites; phase separation and magnetic field orientation," Liquid Crystals, 1994, vol. 16, No. 1:127.
(Continued)

*Primary Examiner* — Jacob T Minskey
(74) *Attorney, Agent, or Firm* — Walter | Haverfeld LLP; Sean F. Mellino; D. Peter Hochberg

(57) ABSTRACT

A method and apparatus for contacting and reacting fine cellulosic material with acid to produce partly-hydrolyzed cellulose, in which the cellulose is compressed to form higher density material, resulting in reduced consumption of acid and increased uniformity of reaction times. Cellulosic material, such as ground wood pulp, is compressed to reduce the interstitial spaces therein. The compressed material is contacted with an acid, such as sulfuric acid, which is allowed to wick into the interstitial spaces and react with the cellulose to produce partly-hydrolyzed cellulose.

22 Claims, 3 Drawing Sheets

(51) Int. Cl.
*D21D 5/00* (2006.01)
*D21F 7/08* (2006.01)
*D21H 11/04* (2006.01)

(52) U.S. Cl.
CPC ..... *D21D 5/005* (2013.01); *D21F 7/086* (2013.01); *D21H 11/04* (2013.01)

(56) References Cited

U.S. PATENT DOCUMENTS

| | | | | |
|---|---|---|---|---|
| 3,345,357 | A * | 10/1967 | Cruz, Jr. | C08B 15/08 536/56 |
| 4,363,671 | A | 12/1982 | Rugg et al. | |
| 4,400,218 | A | 8/1983 | Koch et al. | |
| 4,478,644 | A | 10/1984 | Berger et al. | |
| 4,591,386 | A * | 5/1986 | Rugg | C13K 1/02 127/1 |
| 5,188,673 | A | 2/1993 | Clausen et al. | |
| 5,629,055 | A | 5/1997 | Revol et al. | |
| 5,972,118 | A | 10/1999 | Hester et al. | |
| 6,045,658 | A | 4/2000 | Alheid | |
| 2004/0231661 | A1 * | 11/2004 | Griffin | C12P 7/10 127/1 |

FOREIGN PATENT DOCUMENTS

| | | | |
|---|---|---|---|
| JP | 2012-526886 | A | 11/2012 |
| WO | 99/15564 | A1 | 4/1999 |
| WO | 2010/131088 | A1 | 11/2010 |

OTHER PUBLICATIONS

Dong, X.M. et al, "Effects of Ionic Strength on the Isotropic-Chiral Nematic Phase Transition of Suspensions of Cellulose Crystallites," Langmuir, 1996, vol. 12:2076.

Xiang, Q. et al, "Heterogeneous Aspects of Acid Hydrolysis of α-Cellulose," Applied Biochemistry and Biotechnology, 2003, vol. 107:505-513.

Yu, et al; "Preparation and Characterization of Bamboo Nanocrystalline Cellulose;" BioResources (bioresources.com); vol. 7 (2); pp. 1802-1812; Feb. 22, 2012.

Qua, et al; "Preparation and Characterisation of Cellulose Nanofibres;" J. Material Science; vol. 46; pp. 6029-6045; May 7, 2011.

International Preliminary Report on Patentability (IPRP) dated Nov. 5, 2014 in corresponding PCT/CA2012/050658.

* cited by examiner

PROCESS FOR MAKING PARTLY-HYDROLYZED CELLULOSE USING COMPRESSED CELLULOSIC MATERIALS

CROSS-REFERENCE TO RELATED APPLICATIONS

This application is a National Stage application of International Application No. PCT/CA2012/050658 filed on Sep. 20, 2012, which is incorporated herein by reference in its entirety.

BACKGROUND OF THE INVENTION

Field of the Invention

The invention pertains to processes for producing partly-hydrolyzed cellulose by reacting cellulosic materials with acid.

Background of the Invention

The production of partly-hydrolyzed cellulose by hydrolysis of cellulosic materials from sources such as wood pulp and cotton is a well-known process. In this process, sulfuric, hydrochloric or other strong acid or acid mixture is used to partially hydrolyze finely ground cellulose particles to liberate partly-hydrolyzed cellulose (which is also referred to in the literature as cellulose crystallites or nanocrystalline cellulose). The reaction temperature, acid concentration and reaction time can vary somewhat but they are typically in the range of 60 degrees C.+/−10 degrees C., 60 wt %+/−10%, and about 20 to 60 minutes, respectively, in a stirred batch reactor. Another parameter that can be varied is the acid to cellulose weight ratio, which is typically in the range 10 to 20:1. Once the desired reaction time has been reached, the mixture is quenched with a suitable quantity of water or dilute acid, about ten times the initial mixture mass, to cease the reaction. The bulk of the diluted acid is then removed, typically by centrifugation or dialysis, or both. The diluted acid is neutralized and disposed of, or purified (to remove sugars produced during hydrolysis) and reconcentrated for re-use in the process. The disposal or recovery of this large mass of acid represents a very significant capital or operating expense.

The conventional prior art procedure for producing partly-hydrolyzed cellulose uses a relatively high acid to cellulose weight ratio, on the order of approximately 10 to 20:1 as mentioned above. Even at these relatively high ratios, the mixture produced is very viscous and it is difficult to effectively mix or contact the two components together, especially since the ground cellulose has a very low density, such that the two volumes are similar.

The above process steps are described in the prior art literature, for example: (1) U.S. Pat. No. 5,629,055 to Revol et al.; (2) U.S. Pat. No. 5,188,673 to Clausen et al.; (3) U.S. Pat. No. 5,972,118 to Hester et al.; (4) Jean-Francois Revol, Louis Godbout, Xue-Min Dong, Derek G. Gray, Henri Chanzy, and Georg Maret, "Chiral nematic suspensions of cellulose crystallites; phase separation and magnetic field orientation," *Liquid Crystals*, (1994) Vol. 16, No. 1: 127; and (5) Xue Min Dong, Tsunehisa Kimura, Jean-François Revol, and Derek G. Gray, "Effects of Ionic Strength on the Isotropic-Chiral Nematic Phase Transition of Suspensions of Cellulose Crystallites," *Langmuir*, (1996) Vol. 12: 2076; (6) Qian Xiang, Y. Y. Lee, Päro Pettersson, Robert W. Torget, "Heterogeneous Aspects of Acid Hydrolysis of α-Cellulose," *Applied Biochemistry and Biotechnology*, (2003), Vol. 107: 505-513.

It is important to the prior art hydrolysis reaction that there be a high degree of mixing or contact between the acid and cellulose; otherwise a large variation in cellulose exposure or reaction times can result in a high degree of unreacted cellulose or over-reacted cellulose. This becomes considerably more difficult to achieve at lower acid to cellulose ratios. One reason is that the volume of ground cellulose, at a typical density of about 100 kg/m$^3$, becomes equal to or greater than the volume of acid it is being mixed into, which when sulfuric acid is used, has a density of about 1500 kg/m$^3$. The second reason is that the resulting mixture has a very high viscosity and behaves more like a thick paste than a liquid for some or all of the reaction time.

SUMMARY OF THE INVENTION

The invention provides a method and apparatus for contacting and reacting fine cellulosic material with acid to produce partly-hydrolyzed cellulose, in which the cellulose is compressed to form a higher density material. The invention results in the reduced consumption of acid and an increased uniformity of reaction times. The cost of acid purification and recovery or of acid disposal is accordingly reduced.

According to one aspect of the invention, there is provided a method of reacting cellulosic material with acid to produce partly-hydrolyzed cellulose. Cellulosic material is provided and compressed to produce a compressed cellulosic material. The cellulosic material is contacted with an acid, before, during or after the step of compressing, wherein the weight ratio of the acid to the cellulosic material is 1.5:1 or greater. The compressed cellulosic material is allowed to absorb and react with the acid, to produce partly-hydrolyzed cellulose.

According to a further aspect of the invention, there is provided a method of reacting cellulosic material with acid to produce partly-hydrolyzed cellulose. Cellulosic material is provided and is compressed to reduce interstitial spaces therein and produce a compressed cellulosic material; the compressed cellulosic material is contacted with an acid. The acid is allowed to wick into the interstitial spaces in the compressed cellulosic material and react with the cellulosic material, to produce partly-hydrolyzed cellulose.

Another aspect of the invention provides an apparatus for reacting cellulosic material with acid to produce partly-hydrolyzed cellulose. The apparatus has means for feeding cellulosic material into the apparatus to reduce interstitial spaces therein and form compressed cellulosic material, means for contacting the compressed cellulosic material with an acid downstream of the means for compressing, for wicking of the acid into the interstitial spaces in the compressed cellulosic material, means for holding the compressed cellulosic material and absorbed acid during reaction therebetween to form partly-hydrolyzed cellulose, and means for releasing the partly-hydrolyzed cellulose from an output zone of the apparatus.

A further aspect of the invention provides an apparatus for reacting cellulosic material with acid to produce partly-hydrolyzed cellulose. The apparatus has a conveyor; means for feeding cellulosic material onto the conveyor; rollers for compressing the cellulosic material on the conveyor to form a layer of compressed cellulosic material; means for applying acid to the compressed cellulosic layer for absorption of the acid into the compressed cellulosic material; and means for holding the layer of compressed cellulosic material and absorbed acid during reaction therebetween to form partly-hydrolyzed cellulose.

Further aspects of the invention and features of specific embodiments are described below.

DETAILED DESCRIPTION

Figure 1:
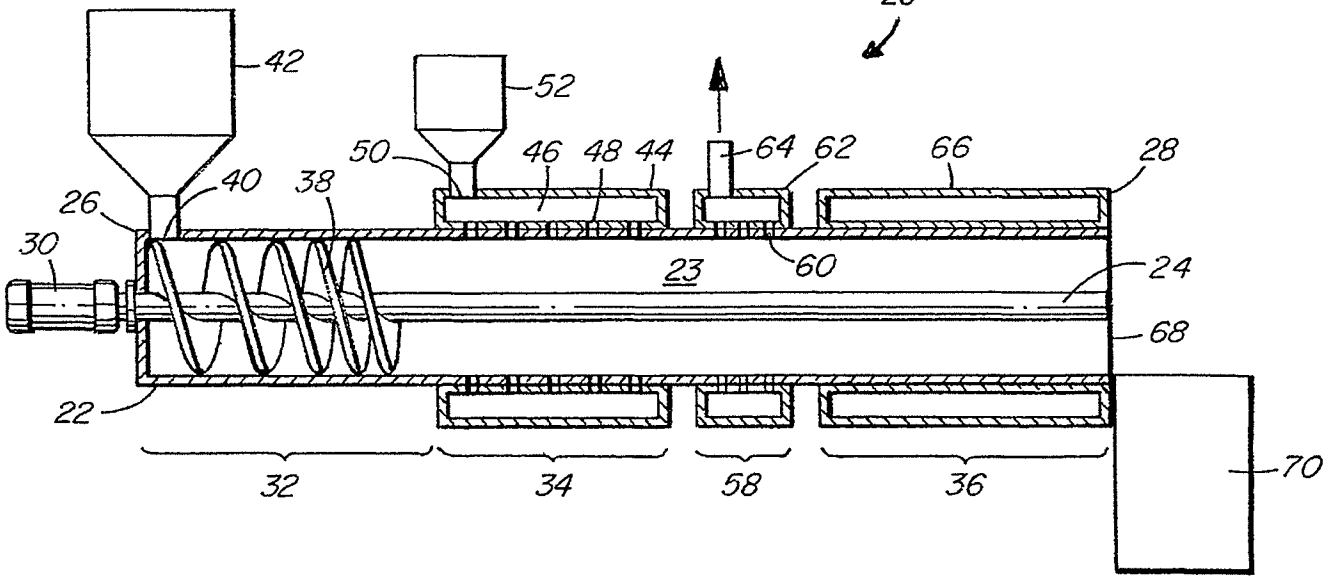
FIG. 1 is a schematic diagram of one embodiment of an apparatus according to the invention, incorporating a screw-type compressor.

The inventive method of making partly-hydrolyzed cellulose uses a compressed volume of fine bleached chemical pulp, or other cellulosic material such as cotton, which absorbs acid, allowing effective acid and cellulose contacting without external mixing, or with minimal mixing, and at much lower acid to cellulose ratios. The absorption into the cellulosic material is by wicking, i.e. the conveying of the liquid into the interstitial spaces in the compressed cellulosic material by capillary action. The cellulosic material used in the invention is fine, having for example a mesh size in the range of 20 to 100 mesh. The cellulosic material may be made fine by grinding, milling or otherwise comminuting to the desired mesh size.

In one embodiment, dried, bleached Kraft pulp is first finely ground to a size in the range of 20 to 100 mesh. The ground pulp is fluffy and has a density in the range of about 50-100 kg/m$^3$. The ground pulp is then compressed to form a body of compressed cellulosic material. The density of the compressed material may be approximately 500 kg/m$^3$ or in the range of about 200-1200 kg/m$^3$. The compressed cellulosic material is then contacted with a quantity of sulfuric acid and the acid is allowed to wick into the material, without agitation. The acid to cellulose weight ratio is preferably as low as possible while still wetting all of the cellulose at about 2:1 for a cellulose density of about 500 kg/m$^3$, but may be in the range of 1.5 to 5:1. The sulfuric acid strength may be about 60 weight %, or in the range of 50 to 70 weight %. Alternatively, other acids, such as hydrochloric acid, or acid mixtures, may be used instead of sulfuric acid.

It is desirable to introduce the acid at an elevated temperature near the desired reaction temperature. Accordingly, the acid is preheated to a temperature of about 60 degrees C., or in the range of about 50 to 70 degrees C. During the absorption of the acid and the hydrolysis reaction, the temperature of the mixture is maintained at about 60 degrees C., or in the range of about 50 to 70 degrees C. The reaction is left to proceed until the desired degree of hydrolysis of the cellulose is achieved, for example for a period of about 45 minutes, typically in the range of about 20 to 60 minutes. The hydrolysis reaction is then stopped by quenching the reaction mixture with water. The partly-hydrolyzed cellulose, being the reaction product, is then purified by conventional steps, such as settling, centrifuging, dialyzing, filtering and drying.

Optionally, a vacuum may be applied to the compressed cellulose during the period of absorption and reaction, to extract air and thereby promote the absorption of the acid into the compressed mass and reduce the potential for unwetted regions within the cellulose matrix caused by the presence of entrapped air.

Over the range of acid concentrations and temperatures indicated above, it was observed that complete acid wicking into the compressed pulp occurred very quickly at an acid to pulp weight ratio of about 4:1 without any external mixing. At lower acid to pulp weight ratios, some manual manipulation or external mixing is helpful to achieve full contacting. At a ratio of 1:1, full contacting of the pulp by the acid did not appear possible for the cellulose density used, about 500 kg/m$^3$. At that cellulose density, a minimum acid to cellulose ratio of about 2:1 seemed to be the minimum. This corresponded to an acid volume equal to the voidage within the compressed pulp, indicating that higher density cellulose, with lower voidage, may require less acid to fill the interstitial spaces and fully wet the cellulose. Thus it is believed possible to reduce the acid to pulp weight ratio further by increasing the cellulose density or using a less dense acid. This is desirable, as the goal is to minimize the acid usage for a given partially hydrolyzed cellulose product rate.

In the production of partly-hydrolyzed cellulose, the acid concentration is of high importance, with changes of even 1% having a dramatic impact on the yield and resulting properties, for a given set of conditions. At commonly-encountered indoor air temperatures and humidities, "dry" pulp may contain about 4 to 10 wt % water. At the acid to cellulose weight ratios discussed in the prior art, i.e. about 10 to 20:1, this water content has a relatively small impact on the acid concentration. For example, 10 g of cellulose containing 0.5 g of water (5%), would reduce the effective concentration of 100 g of 62 wt % acid to 61.7 wt %. However, at the reduced acid to cellulose weight ratios employed in the present invention, e.g. about 2 to 4:1, this moisture has a much greater impact. For example, 10 g of cellulose containing 0.5 g of water would reduce the effective concentration of 20 g of 62 wt % acid to 60.5 wt %. This decrease in acid concentration also results in a slight increase in reaction temperature due to the heat of mixing.

Similarly, the lower acid to cellulose ratios also result in an increased impact of the cellulose temperature on the final mixture temperature due to the cellulose being a much greater percentage of the total mass.

It is undesirable to simply increase the acid temperature or concentration significantly above the desired reaction conditions stated above to offset these effects, due to the higher reaction rate that occurs in some parts of the mixture until thermal and concentration equilibrium is reacted. It is preferable to preheat and/or dry the cellulose as required.

In a further embodiment of the method of invention, rather than completing the compression of the cellulosic material prior to contacting it with the acid, as described above, the acid, or some of the acid, is applied to the cellulosic material before compression, or during compression, or both. This procedure requires that the compression is done sufficiently quickly that only a small part of the total reaction time has elapsed before the compression is completed, so that there is not an overly large difference in acid contacting time between the small portion of cellulosic material that initially contacts the acid, and the bulk that occurs via wicking during or immediately after compression. Apart from this difference in the timing of the application of the acid, the process is the same as described above.

FIG. 1 is a schematic diagram of one embodiment of the apparatus for reacting cellulosic material with acid, in which a screw-type compressor is used to compress the cellulosic material. The apparatus 20 is intended to be operated on a continuous throughput basis. It has a cylindrical tube 22 through which extends a shaft 24, journalled at each end 26, 28 of the tube and rotatable by a motor 30. There is an annular space 23 between the shaft 24 and the inner surface of the tube, through which the material is conveyed. Though not shown in FIG. 1, in practice, either the diameter of the shaft 24 increases or the inner diameter of the tube 22 decreases in the direction from left to right in FIG. 1, to cause a compressing force on the cellulosic mass to be pressed. The tube has three principal sections, namely, a compression section 32, an acid application section 34, and a holding section 36. In the compression section, the shaft 24 has flights 38 affixed thereto and configured to convey pulp through the tube and compress it. A pulp input port 40 and pulp hopper 42 are provided proximate to the input end or zone 26 of the tube for feeding low density ground pulp into the compression section 32.

The acid application section 34 of the tube 22 is surrounded by a jacket 44, which is separated from the outer surface of the tube by a gap 46. A plurality of holes 48 is provided around the circumference of the tube within the jacket, whereby the interior space 23 of the tube is in fluid communication with the gap 46. An acid input port 50 in the jacket and acid supply tank 52 provide for a flow of acid into the gap 46 and thus through the holes 48 into the interior space 23 of the tube 22. The holes 48 provide a plurality of introduction points for the acid into the compressed pulp, to minimize the wicking path required.

The compression section 32 preferably precedes the acid application section 34; however, the apparatus would also function with acid introduction first, or simultaneously with compression, so long as the compression was sufficiently fast to complete the contacting before a significant percentage of the total reaction time had been completed.

An air extraction section 58 is provided downstream of the acid application section 34. The tube 22 in this section is perforated by a plurality of holes 60 around its circumference and is surrounded by, and spaced from, a vacuum jacket 62 having a vacuum port 64 for connection to a vacuum pump or other source of vacuum. This section functions to permit the extraction of air from the plug of compressed cellulosic material, promoting wicking of the acid into the plug and preventing air from being trapped within it. Optionally, the air extraction section 58 may be positioned between the compression section 32 and the acid application section 34. Optionally, the air extraction section may be omitted altogether, where air entrapment in the plug is not significant.

The holding section 36 is positioned downstream of the acid application section 34 and the air extraction section 58. In the holding section, the tube 22 is surrounded by a heating jacket 66. The holding section holds the mixture of acid and compressed pulp at the desired temperature until the desired reaction time is reached. The length of the holding section 36 is selected accordingly. Dispersion or back-mixing of the material in the holding section should be minimized in order to achieve the most uniform reaction time and product.

Optionally, in the acid application and holding sections of the apparatus, pins or other means of gently agitating the mixture (not shown) may be provided to promote contact between the acid and cellulosic material and reduce acid requirements.

An output port 68 is provided at the outlet end or zone 28 of the tube for release of the reacted material. An agitated tank 70 is provided downstream of the outlet. Here, the material may be vigorously contacted with water or dilute acid to stop the reaction. Alternatively, a static or dynamic mixer may be used in place of an agitated tank.

Figure 2:
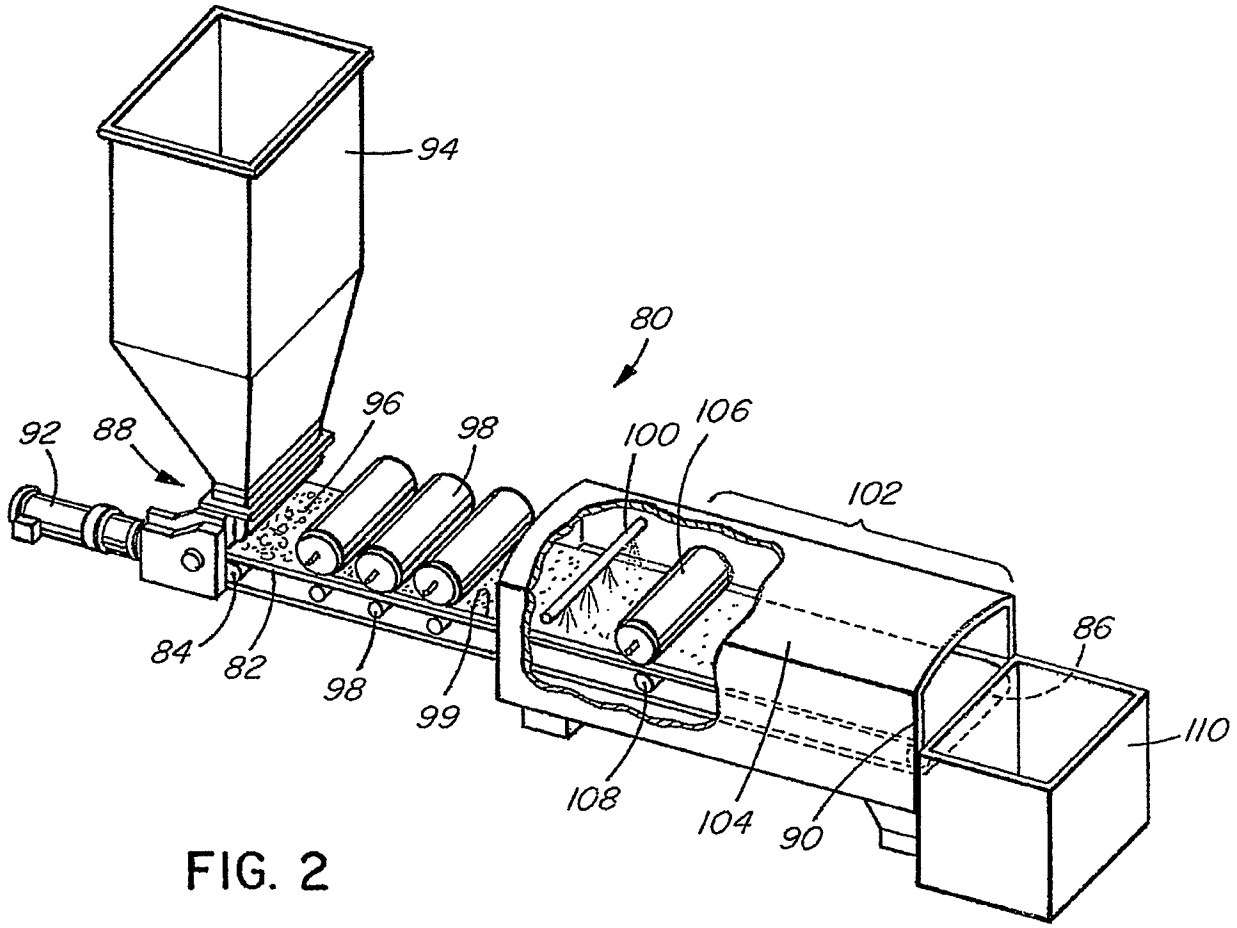
FIG. 2 is a schematic diagram of a second embodiment of an apparatus according to the invention, incorporating a conveyor belt and roller-type compressor.

FIG. 2 is a schematic diagram of a second embodiment of the apparatus for reacting cellulosic material with acid, in which rollers are used to compress the pulp. The apparatus 80 has a conveyer belt 82 movable on rollers 84, 86 at the input end or zone 88 and output end or zone 90 respectively of the belt. One roller 84 is driven by a motor 92. At the input end 88, a pulp hopper 94 is provided for feeding low density pulp 96 onto the belt. Rollers 98 are provided downstream of the hopper for compressing the pulp 96 between the rollers and the belt 82, to form a layer of compressed pulp 99 on the belt. The amount of cellulose, belt width, roller compression and belt speed can be tailored for the desired final cellulose density and layer thickness or wicking distance required.

An acid sprayer 100 is provided downstream of the rollers 98 to spray a heated acid solution onto the compressed pulp layer 99. A holding section 102 is between the acid sprayer 100 and the output end 90 of the belt. In the holding section, the mixture of compressed pulp and acid is held, at the desired reaction temperature and for the desired reaction time. This section 102 is enclosed by a heating jacket 104 for controlling the temperature of the reaction. Optionally, the acid sprayer 100 may be within the heating jacket 104.

Within the holding section 102, there may optionally be provided one or more additional sets of rollers 106 to apply pressure to the compressed pulp layer 99, in order to speed the acid penetration, improve acid contacting and reduce acid requirements. There may also optionally be provided an air extraction means 108, to apply vacuum to the underside of an air-permeable conveyer belt 82 and thereby to the compressed layer 99.

An agitated tank 110 is arranged to receive the product that exits the output end 90 of the conveyer belt for contacting the material with water or dilute acid to stop the hydrolysis reaction.

The function of the rollers 98 may alternately be achieved using a shoe press or extended nip press for moving webs, as described in Alheid, U.S. Pat. No. 6,045,658.

EXAMPLES

Comparative Example 1

As a control, 10 g of dry bleached Kraft pulp was ground to a fineness of 20-100 mesh with a knife mill. Following this procedure the loose, fluffy pulp had a density of between 50 and 100 kg/m$^3$. This finely ground dry Kraft pulp was reacted with 90 g of 60% sulfuric acid in a continuously mixed beaker in a water bath at 65 degrees C. for 45 minutes. Contacting this uncompressed, fluffy pulp with acid showed that only a small amount of wicking into the loose pulp mass occurs, and external mixing was required in order to force the pulp into the acid and fully wet the pulp. The resulting mixture was initially very thick and difficult to mix at the acid ratio used (about a 9:1 acid to pulp weight ratio, which is near the lower limit of what is possible using a stirred vessel). Following the reaction time, the mixture was then quenched with 1000 mL of de-ionized water, and allowed to settle overnight. In the morning the clear supernatant layer was decanted off and the approximately 300 g remaining suspension was divided into 10-30 mL aliquots which were treated in a lab-scale batch centrifuge for 10 minutes at 1,100 rpm. The aliquots were then decanted, refilled with de-ionized water, and treated again in the centrifuge two more times until the suspension no longer separated. This corresponded to a pH of about 1.2. The 10 individual aliquots were then placed in dialysis bags and dialyzed with de-ionized water until reaching a pH of at least 3.3. The colloidal partly-hydrolyzed cellulose was then decanted, sonicated for 90 minutes, filtered through a 0.3 micron filter and dried overnight at 40 degrees C. into a thin film. This control method produced 0.83 g of dried partly-hydrolyzed cellulose film indicating a yield of 8.3%.

Example 2

Figure 3:
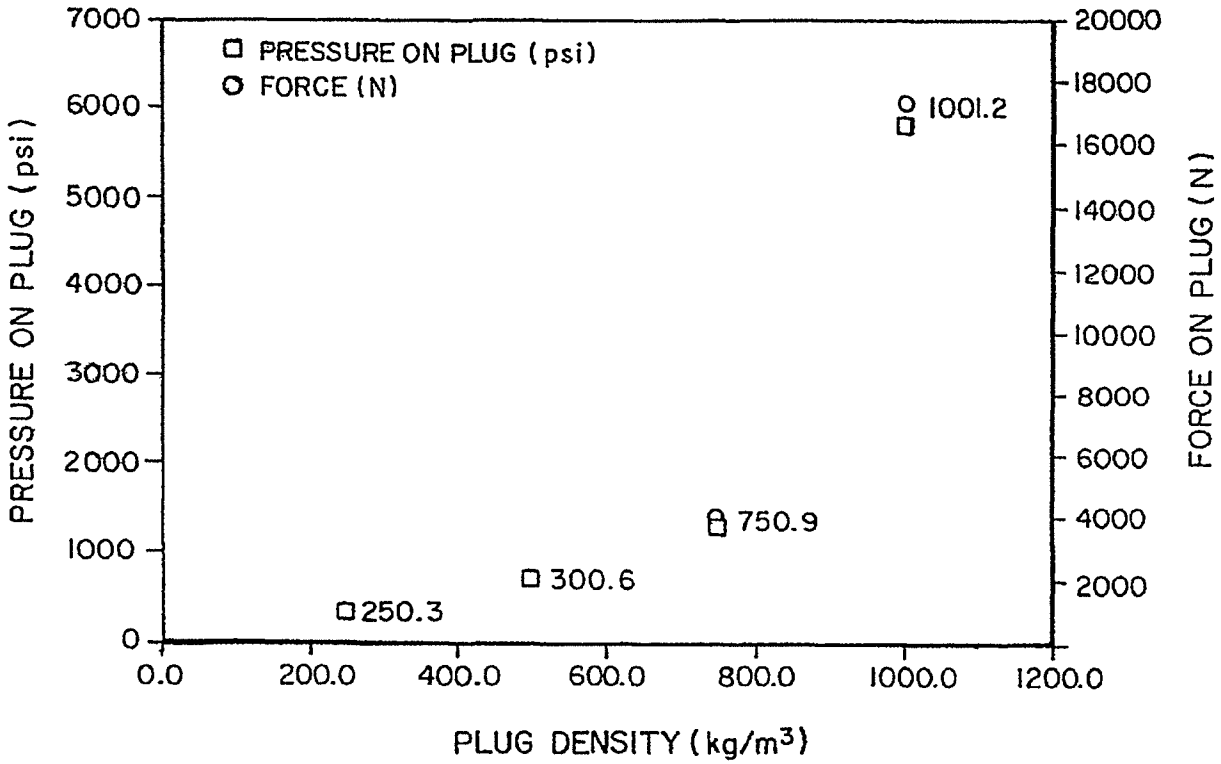
FIG. 3 is a graph of cellulose plug density as a function of compression force.

Samples of the low density pulp described in Example 1 were placed within a 2.54 cm inside diameter glass cylinder and then compressed using a hydraulic press at various compression ratios to produce compressed plugs of varying density. The compressed pulp re-expanded only slightly once the pressure is removed, such that the compressed material maintained nearly the same increased density. The compression force versus resulting pulp density data are set out in FIG. 3. For most of the experiments discussed below a pulp plug density of approximately 500 kg/m$^3$ was used, being intermediate between the higher (1000 kg/m$^3$) and somewhat lower densities (250 kg/m$^3$).

Example 3

Four compressed plugs of finely ground dry Kraft pulp, 2.54 cm diameter each by approximately 1 cm high (10.6 g total), were contacted with 60 wt % sulfuric acid at 65 degrees C. for 45 minutes at an acid to pulp weight ratio of 4.5:1 using the wicking contacting method of the invention. During the reaction period the mixture was only gently stirred once every few minutes to help maintain temperature uniformity in the small lab-scale apparatus. After 45 minutes, the mixture was quenched with about 1000 mL of de-ionized water, settled, centrifuged, dialyzed, filtered and dried to a film as described above for Example 1. This wicking method also produced 0.83 g of dried partly-hydrolyzed cellulose film, indicating a very similar 7.8% yield while using half the acid ratio of Example 1.

Example 4

It was discovered that at sulfuric acid concentrations above about 63 to 64 wt %, there was a significant transition in wicking performance. Above this threshold concentration, the ground pulp plug no longer rapidly absorbed the sulfuric acid. Instead, a thin sticky film, less than about 1 mm thick, was produced, which inhibited further acid absorption. Additional experiments confirmed that this effect remained, even when the acid was cooled to minus 6 degrees C. Not only did the pulp not wick above the acid concentration threshold, but it was also not possible to force the acid through the plug using pressure (about 40 psig), vacuum (about −10 psig) or a combination of the two. Fairly intense mixing, which broke the pulp into very small pieces, was required to achieve fully contacting above the concentration threshold. To make use of the wicking properties of the cellulose, and maximize contacting efficiency, it is beneficial to stay below this threshold concentration, otherwise significant mixing, or a very short wicking distance will be required, which is difficult to achieve given the nature of the mixture. It is believed that the use of mixed acids, such as sulfuric and hydrochloric acids, or other soluble additives which affect the solvation properties of the acid, can be used to expand the acid concentration range where wicking occurs. It is also believed that sulfuric acid concentrations above 63-64 wt % can be used where the compressed cellulose is in a sufficiently thin layer, for example using the apparatus of FIG. 2.

As will be apparent to those skilled in the art in the light of the foregoing disclosure, many alterations and modifications are possible in the practice of this invention without departing from the scope thereof. Accordingly, the scope of the invention is to be construed in accordance with the following claims.

The invention claimed is:

1. A method of reacting cellulosic material with acid to produce cellulose crystallites, comprising the steps of:
(a) providing dry cellulosic material;
(b) compressing the dry cellulosic material to produce a compressed cellulosic material;
(c) contacting the dry cellulosic material with an acid solution, before, during or after step (b), wherein the weight ratio of the acid solution to the cellulosic material is in the range of 1.5:1 to 5:1;
(d) allowing the compressed cellulosic material to absorb and react with the acid, at a temperate of 70 degrees C. or less, to produce cellulose crystallites; and
(e) separating the produced cellulose crystallites from the acid.

2. A method according to claim 1, wherein the compressed cellulosic material has a density in the range of 200-1200 kg/m$^3$.

3. A method according to claim 1, wherein the compressed cellulosic material has a density in the range of 450-550 kg/m$^3$.

4. A method according to claim 1, wherein the weight ratio of acid solution to the cellulosic material is in the range of 2:1 to 5:1.

5. A method according to claim 1, wherein the weight ratio of the acid solution to the cellulosic material is in the range of 4:1 to 5:1.

6. A method according to claim 1, wherein the acid is sulfuric acid.

7. A method according to claim 6, wherein the concentration of the acid in the acid solution is less than 64 weight %.

8. A method according to claim 6, wherein the concentration of the acid in the acid solution is in the range of 50 to 70 weight %.

9. A method according to claim 1, wherein the cellulosic material is selected from the group consisting of ground cellulosic material and milled cellulosic material.

10. A method according to claim 1, wherein the cellulosic material has a mesh size in the range of 20-100 mesh.

11. A method according to claim 1, wherein the cellulosic material comprises wood pulp.

12. A method according to claim 1, wherein step (c) is done without agitation of the compressed cellulosic material.

13. A method according to claim 1, wherein step (c) is done with agitation of the compressed cellulosic material.

14. A method according to claim 1, further comprising the step of, before step (b), pre-heating the cellulosic material.

15. A method according to claim 1, wherein step (d) is done at a temperature in the range of 50 to 70 degrees C.

16. A method according to claim 1, further comprising the step of heating the acid to a temperature in the range of 50 to 70 degrees C. before step (c).

17. A method according to claim 1, further comprising the step of contacting the product of step (d) with a fluid comprising water, to terminate the reaction.

18. A method according to claim 1, further comprising the step of extracting air from the compressed cellulosic material.

19. A method according to claim 18, wherein the step of extracting air is done by applying a vacuum to the compressed cellulosic material.

20. A method according to claim 1, wherein the dry cellulosic material has a water content of 10 wt % or less.

21. A method according to claim 1, wherein the dry cellulosic material has a water content in the range of 4 to 10 wt %.

22. A method according to claim 1, wherein the step of compressing the dry cellulosic material reduces interstitial spaces therein and wherein the compressed cellulosic material absorbs the acid by wicking.

* * * * *